US008601935B2

(12) United States Patent
Giacchi et al.

(10) Patent No.: US 8,601,935 B2
(45) Date of Patent: Dec. 10, 2013

(54) LINEAR COMPRESSOR OR REFRIGERATING UNIT COMPRISING A DISCHARGE DEVICE FOR FLUID CONDENSATE

(75) Inventors: Marco Giacchi, Waldstetten (DE); Thorsten Kusnik, Bächingen (DE); Jan-Grigor Schubert, Senden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 958 days.

(21) Appl. No.: 12/223,996

(22) PCT Filed: Jan. 15, 2007

(86) PCT No.: PCT/EP2007/050347

§ 371 (c)(1),
(2), (4) Date: Feb. 25, 2010

(87) PCT Pub. No.: WO2007/098981

PCT Pub. Date: Sep. 7, 2007

(65) Prior Publication Data

US 2010/0218548 A1 Sep. 2, 2010

(30) Foreign Application Priority Data

Feb. 28, 2006 (DE) ..... 10 2006 009 274

(51) Int. Cl.
*F04B 39/16* (2006.01)

(52) U.S. Cl.
USPC ..... 92/169.1; 92/86.5; 92/153

(58) Field of Classification Search
USPC ..... 92/86, 169.1, 166, 169.4, 171.1, 79, 92/86.5; 417/417, 433, 434, 435; 60/407–413, 150, 272, 285, 453
See application file for complete search history.

(56) References Cited

U.S. PATENT DOCUMENTS

| | | | | |
|---|---|---|---|---|
| 4,199,329 | A | 4/1980 | Bouchard | |
| 4,873,913 | A | 10/1989 | Pruitt et al. | |
| 5,525,845 | A * | 6/1996 | Beale et al. | 310/30 |
| 5,645,354 | A * | 7/1997 | Heinzl et al. | 384/100 |
| 6,575,716 | B1 | 6/2003 | Morita et al. | |
| 6,966,761 | B1 * | 11/2005 | Roke et al. | 417/417 |
| 2004/0057844 | A1 * | 3/2004 | Park | 417/360 |
| 2004/0234388 | A1 * | 11/2004 | Chumley et al. | 417/313 |
| 2006/0162361 | A1 * | 7/2006 | Roche et al. | 62/246 |

FOREIGN PATENT DOCUMENTS

RU 2210683 C1 12/2001

OTHER PUBLICATIONS

International Search Report PCT/EP2007/050347.

* cited by examiner

*Primary Examiner* — Thomas E Lazo
(74) *Attorney, Agent, or Firm* — Nixon & Vanderhye, PC

(57) ABSTRACT

A linear compressor comprising a piston housing; a compressor piston configured for reciprocatory motion with the piston housing along an axis thereof, whereby the compressor piston is mounted in the piston housing a housing wall having openings formed therein with a gaseous fluid flowing through the openings; and a discharge device for fluid condensate.

13 Claims, 1 Drawing Sheet

LINEAR COMPRESSOR OR REFRIGERATING UNIT COMPRISING A DISCHARGE DEVICE FOR FLUID CONDENSATE

BACKGROUND OF THE INVENTION

The invention relates to a linear compressor or a refrigerating unit comprising a piston housing and a compressor piston movable back and forth therein along an axis, whereby the compressor piston is mounted in the piston housing by means of a housing wall having openings and a gaseous fluid flowing through the openings.

In oil-free linear compressors a compressor piston is separated from the housing wall by a cushion of gaseous refrigerant which flows into the compressor piston through micro-openings through a housing wall of a piston housing. To maintain this gas pressure bearing provided by the cushion it is necessary to have a continuous inflow of gas as otherwise contact takes place between the compressor piston and the housing wall, causing friction and therefore wear. It is a known approach to form the gas cushion by means of numerous micro-holes drilled in the cylinder wall. U.S. Pat. No. 6,575,716 provides for a circumferential groove in the housing wall with a central supply hole.

During the startup phase of the compressor, which usually takes several minutes until the compressor reaches its working temperature, a partial amount of the refrigerant compressed by the compressor may condense owing to a low temperature accompanied by high pressure. The condensate mainly forms on the outside of the housing wall designed as a cylinder sleeve, which wets and blocks the micro-holes drilled in the housing wall. This wetting of the micro-nozzles considerably impedes the inflow of gas needed for the gas pressure bearing and, if large areas are wetted, can lead to inadequate functioning of the gas pressure bearing. This condensation effect can be exacerbated by the pressure difference in front of and behind the micro-hole if a refrigerant evaporates on the inner wall of the housing as such evaporation causes the housing wall to become colder.

The condition of the micro-holes being blocked by refrigerant condensation usually lasts for about ten minutes. It can, however, last for much longer. It only ends when the friction of the compressor piston on the housing wall and the compression heat have heated up the entire system adequately for a critical temperature range to have been exceeded.

Under certain circumstances, the evaporation coldness can stabilize the condensation of the refrigerant, so that the frictional heat is not enough to take the temperature above the critical range and only when considerable damage is caused to the linear compressor is the friction high enough to produce enough heat. This is an undesirable situation, however, as it reduces the efficiency of the linear compressor and shortens its service life.

Particularly hard surface coatings are applied to the compressor piston to reduce the wear caused by the frictional phases during startup and slowdown to an acceptable level. Such surface coatings are, however, comparatively expensive.

A suitable heat bridge between the pressure side of the linear compressor and the gas pressure bearing can be used to prevent ongoing condensation, but this entails a loss in performance during the startup phase.

BRIEF SUMMARY OF THE INVENTION

The object of the present invention is therefore to provide a linear compressor or a refrigerating unit comprising said linear compressor as well as a method of producing such, with which the service life and efficiency can be increased by simple means. The object also includes presenting a method for cooling merchandise, which permits a particularly speedy, reliable and energy-saving cooling of merchandise.

This object is achieved in accordance with the invention by the linear compressor, by the refrigerating unit, by the production method and by the cooling method as stated in the independent claims. Further advantageous configurations and developments, which can be used individually or in any desired combination with each other, are the subject matter of the dependent claims.

The linear compressor in accordance with the invention comprises a piston housing and a compressor piston movable back and forth therein along an axis, whereby the compressor piston is mounted in the piston housing by means of a housing wall having openings and a gaseous fluid flowing through the openings, whereby a discharge device is provided for fluid condensate. The fluid can be a refrigerant.

The housing wall with the openings forms a gas pressure bearing, which creates a gas cushion through a continuous flow of the fluid into the space between the compressor piston and the housing wall. The gas cushion ensures that the compressor piston is supported contactlessly in front of and by the housing wall. The openings can exhibit a mean diameter in the range from 0.005 mm to 0.3 mm, in particular in a range from 0.01 mm to 0.100 mm, preferably in a range from 0.02 mm to 0.04 mm. The fluid can be provided by means of a pressure supply line from the pressure side of the linear compressor. The fluid can be a refrigerant.

The discharge device ensures that the condensed fluid is kept away or removed from the openings. The discharge device prevents the openings from being wetted or stops any wetting that has started so that a blockage of the openings which would result in an at least partially inadequate functioning of the gas pressure bearing is avoided or at least reduced. The reduced wetting lowers friction and therefore wear. As a result the service life of the linear compressor is lengthened and its efficiency is increased.

In a first configuration, the discharge device is formed by a recess made in the piston housing which forms a collection basin for fluid condensate.

The fluid condensate flows into the recess and collects there. With the aid of the collection basin the fluid condensate flows away from the housing wall and therefore cannot wet or block any further openings. The size of the recess has to be such that the quantity of fluid condensate arising during the startup phase of the linear compressor can be accommodated.

In a second configuration, the discharge device is formed by having a pressure supply line for gaseous fluid entering at a lowest point of the piston housing.

The gaseous fluid required for the gas pressure bearing is provided to the housing wall by means of the pressure supply line. By locating the pressure supply line at the lowest point of the piston housing the pressure supply line also serves as the return line for the fluid condensate. Under the force of gravity, the fluid condensate can flow down through the pressure supply line from inside the piston housing.

In a third configuration, a suction connection and a pressure connection are provided and the discharge device is formed by having the pressure connection form a lowest point of the piston housing.

If fluid condensate forms inside the piston housing it collects at the lowest point of the piston housing, and can discharge from the piston housing via the pressure connection.

Advantageously, the fluid condensate is then pressed out of the linear compressor into a condenser of a refrigeration system or flows under the force of gravity into the condenser. This configuration too reduces linear compressor wear as the degree to which the openings are blocked is reduced. By reducing the number of blocked openings, the level of friction is lowered and this increases the efficiency of the linear compressor.

In a fourth configuration, the housing wall exhibits a side facing the compressor piston and a side facing away from the compressor piston and the discharge device is formed by providing pores and/or grooves on the side facing away from the housing wall, in particular, in the direct vicinity of the openings. The pores or grooves have the function of developing capillary forces in relation to the fluid condensate which remove or lead the fluid concentrate away from the openings.

Advantageously, the diameter of the pores or the width of the grooves is smaller than the diameter of the openings. Such dimensioning of the pores or grooves ensures that the capillary forces in the pores or grooves are greater than in the respective openings, so that the liquid fluid condensate is drawn out of the openings as a result of the pore size gradient.

The pores can be formed by a porous material which is for example a sintered metal or a sintered ceramic and which is applied to the outside of a housing wall configured as a cylinder sleeve.

The grooves can also be inserted directly on the side of the housing wall facing away from the compressor piston. The grooves can, for example, be made by being scribed or pressed into the housing wall. Here too, adhesion forces of the grooves cause the liquid condensate to be drawn out of the openings.

Advantageously, a heater is provided in the piston housing, in particular on and/or in the housing wall. By means of the heater, fluid condensate can be evaporated. The heater is provided, for example, on the side facing away from the compressor piston. By means of the heater, the housing wall can be heated to a temperature which is above the condensation point of the fluid. In principle, this concept can be realized separately and without the discharge device.

The operation of the heater can be controlled in such a way that it is only provided during the startup phases of the linear compressor. As a result the heat required during the startup phase is supplied and unnecessary heat is not produced during normal operation of the linear compressor.

In a special configuration the linear compressor is oil-free. To reduce wear of the linear compressor a particularly hard surface coating of the compressor piston is provided.

The housing wall is advantageously configured as a cylinder housing in which the compressor piston moves in a reciprocating manner.

The refrigerating unit in accordance with the invention exhibits the linear compressor in accordance with the invention. The refrigerating unit achieves a particularly long service life and a high degree of efficiency. The friction in the linear compressor is reduced and along with it, the wear of the compressor piston and housing wall. The refrigerating unit can be a refrigerator, a freezer and/or an air conditioning unit, in particular, an air conditioning unit for motor vehicles.

The method in accordance with the invention for cooling merchandise uses the refrigerating unit in accordance with the invention. It is able to cool or keep cool merchandise, in particular food, quickly and reliably while at the same time saving energy.

BRIEF DESCRIPTION OF THE DRAWINGS

Further advantageous or special configurations are explained in more detail with reference to the following drawing which is intended not to restrict the invention but merely to illustrate it by way of example. The drawing contains the following schematic diagrams.

DETAILED DESCRIPTION OF THE PRESENT INVENTION

Figure 1:
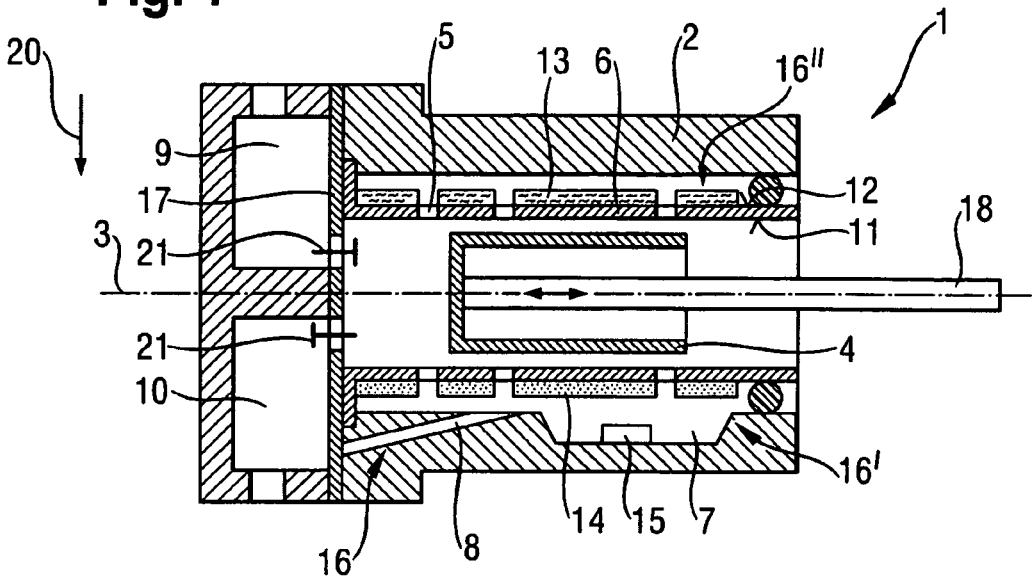
FIG. 1 is a sectional view of a first configuration of the linear compressor in accordance with the invention.

FIG. 1 shows, in a longitudinal section, a first embodiment of the linear compressor 1 with a piston housing 2 in which along an axis 3 a compressor piston 4 is moved back and forth by means of a piston rod 18. The compressor piston 4 is supported by means of a housing wall 6, which exhibits openings 5, and a fluid flowing through the openings 5 which forms a gas cushion between the housing wall 6 and the compressor piston 4. By maintaining a continuous gas flow through the openings 5, the compressor piston 4 is guided contactlessly in the housing wall 6, which is configured as a cylinder sleeve. The linear compressor 1 exhibits a suction connection 9 and a pressure connection 10 which by means of a valve plate 17 are switched on and off in correct phase sequence. The piston housing 2 exhibits a recess 7 which serves as a discharge device 16' for the fluid condensate. Any fluid condensate which is formed runs from the housing wall 6 configured as a cylinder sleeve into the recess 7 and collects there. This fluid condensate cannot then wet any more openings 5. The continuous gas stream is provided by means of a pressure supply line 8 from the pressure connection 10. The housing wall 6 exhibits a side 11 facing towards the compressor piston 4 and a side 12 facing away from the compressor piston 4. On the side 12 facing away, and in the direct vicinity of the openings 5, pores 13 or grooves 14 are provided which exhibit a characteristic size, i.e. in the case of the pores the diameter and in the case of the grooves, the width, which is smaller than the diameter of the openings 5. As a result of such dimensioning, capillary forces are created in relation to the fluid condensate which draw the fluid condensate out of the openings 5. The fluid condensate is thus taken up by the pores 13 or the grooves 14 and the opening 5 is cleared and is therefore available to the gas pressure bearing for compressor piston 4. The pores 13 or grooves 14 represent a further configuration of a discharge device 16". By means of valves 21 the fluid is supplied or removed in correct phase sequence.

Figure 2:
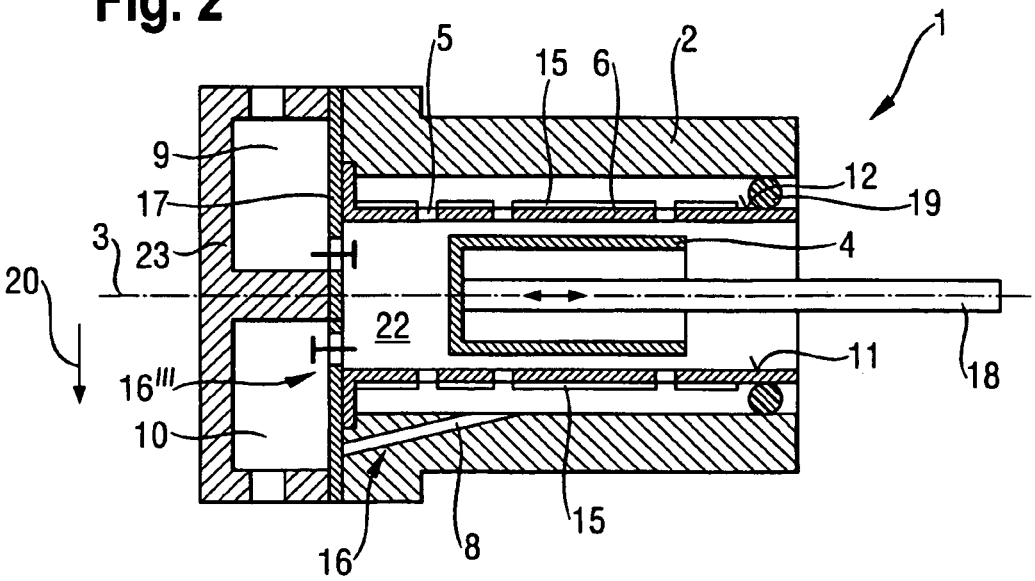
FIG. 2 is a sectional view of a second configuration of the linear compressor in accordance with the invention.

FIG. 2 shows a further configuration of the linear compressor 1 in accordance with the invention, whereby on a side 12 of the housing wall 6 facing away from the compressor piston 4 a heater 15 is provided, by means of which the housing wall 6 with the openings 5 therein is heated to such an extent that no fluid condensate can precipitate or fluid condensate which has already precipitated is evaporated. The temperature is greater than the condensation temperature of the fluid at the mean pressure prevailing in the piston housing. Advantageously, the heater is only switched on during the startup phase of the linear compressor 1 and remains switched off during normal operation of the linear compressor 1. The pressure connection 10 of the compression space 22 is located at the lowest point of a cover 23 of the linear compressor 1, so that any liquid fluid collecting, such as a refrigerant from the linear compressor 1, is pressed out into a condenser of the refrigeration system (not shown) or can flow into the condenser under the force of gravity. In this configuration the arrangement of the pressure connection 10 forms a discharge device 16'" at the lowest point. Furthermore, in the piston housing 2 a pressure supply line 8 is provided which supplies the housing wall 6 with gaseous fluid from the pressure side 10 and which enters at a lowest point of the piston housing 2, so that any fluid condensate collecting can flow off under the force of gravity through the pressure supply line 8. The pressure supply line 8 therefore serves as the return line for the fluid condensate. With suitable positioning of the valve plate 17, the fluid condensate can flow off to the pressure connection 10.

The arrangement of the pressure supply line 8 at a lowest point of the piston housing 2 constitutes a further configuration of the discharge device 16.

The various variants of the discharge device 16, 16', 16", 16''' form various measures for avoiding inadequate functioning of the gas pressure bearing caused by wetting of the openings required for the gas pressure bearing. They can, in each case, be used singly or combined with each other as desired. All the variants have the effect individually that fewer openings are blocked by fluid condensate, as a result of which the gas pressure bearing of the compressor piston 4 in the piston housing 2 is improved and functions more reliably. Wear is reduced, the service life of the linear compressor 1 is lengthened and its efficiency increased.

The linear compressor 1 in accordance with the invention or the refrigerating unit in accordance with the invention comprising said linear compressor 1 incorporates a piston housing 2 and a compressor piston 4 movable back and forth therein along an axis 3, whereby the compressor piston 4 is mounted in the piston housing 2 by means of a housing wall 6 exhibiting openings and a gaseous fluid flowing through the openings 5, whereby a discharge device 16, 16', 16", 16''' is provided for fluid condensate and achieves a long service life and particularly high efficiency.

LIST OF REFERENCE NUMBERS

1 Linear compressor
2 Piston housing
3 Axis
4 Compressor piston
5 Openings
6 Housing wall
7 Recess
8 Pressure supply line
9 Suction connection
10 Pressure connection
11 Side facing towards
12 Side facing away
13 Pores
14 Grooves
15 Heater
16, 16', 16", 16''' Discharge device
17 Valve plate
18 Piston rod
19 O-ring
20 Gravity
21 Valve
22 Compression space
23 Cover

The invention claimed is:

1. An oil-free linear compressor comprising a piston housing; a compressor piston configured for reciprocatory motion with the piston housing along an axis thereof, whereby the compressor piston is mounted in the piston housing a housing wall having openings formed therein with a gaseous fluid flowing through the openings to form a gas bearing between the compressor piston and the wall; and a discharge device that discharges fluid condensate if the gaseous fluid condenses during start up.

2. The oil-free linear compressor according to claim 1 wherein the discharge device is formed by a recess inside the piston housing that forms a collection basin for fluid condensate.

3. The oil-free linear compressor according to claim 1 wherein the discharge device is formed by a pressure supply line for gaseous fluid entering at a substantially lowermost point of the piston housing.

4. The oil-free linear compressor according to claim 1 and further comprising a suction connection and a pressure connection wherein the discharge device is formed by a pressure connection forming a substantially lowermost point within the piston housing.

5. The oil-free linear compressor according to claim 1 and further comprising a heater disposed in the piston housing.

6. The oil-free linear compressor according to claim 5, wherein the heater is disposed on the housing wall.

7. The oil-free linear compressor according to claim 1 wherein the housing wall is configured as a cylinder sleeve.

8. The oil-free linear compressor according to claim 1 wherein the housing wall includes a side facing toward the compressor piston and a side facing away from the compressor piston, wherein the discharge device is formed by providing at least one of pores and grooves on the side facing away from the housing wall.

9. The oil-free linear compressor according to claim 8 wherein at least one of a pore diameter and a groove width is smaller than the diameter of the openings.

10. The oil-free linear compressor according to claim 8, wherein the pores and/or grooves are positioned adjacent the openings.

11. refrigerating unit, comprising an oil-free linear compressor including a piston housing; a compressor piston configured for reciprocatory motion with the piston housing along an axis thereof, whereby the compressor piston is mounted in the piston housing a housing wall having openings formed therein with a gaseous fluid flowing through the openings; and a discharge device structured to discharge fluid condensate that would otherwise impede the flow of the gaseous fluid through the openings of the wall.

12. The refrigerating unit according to claim 11, wherein the refrigerating unit comprises a refrigerator and/or freezer.

13. A method for cooling merchandise using a refrigerating unit including the steps of:

providing a refrigeration unit including a piston housing; a compressor piston configured for reciprocatory motion with the piston housing along an axis thereof, whereby the compressor piston is mounted in the piston housing a housing wall having openings formed therein with a gaseous fluid flowing through the openings; and a discharge device that discharges or evaporates fluid condensate of the gaseous fluid that is prone to condense during start up;

placing merchandise for cooling inside the refrigeration unit; and operating the refrigerating unit.

* * * * *

UNITED STATES PATENT AND TRADEMARK OFFICE

CERTIFICATE OF CORRECTION

PATENT NO. : 8,601,935 B2
APPLICATION NO. : 12/223996
DATED : December 10, 2013
INVENTOR(S) : Giacchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1505 days.

Signed and Sealed this
Twenty-second Day of September, 2015

Michelle K. Lee

Michelle K. Lee
*Director of the United States Patent and Trademark Office*